US012392097B2

(12) United States Patent
Nagy et al.

(10) Patent No.: US 12,392,097 B2
(45) Date of Patent: Aug. 19, 2025

(54) RESTORABLE CRASH CUSHION APPARATUS

(71) Applicant: Lindsay Transportation Solutions, LLC, Omaha, NE (US)

(72) Inventors: Joseph Nagy, Rio Vista, CA (US); Robert Hendricks, Omaha, NE (US); Augusto Piccinini, Milan (IT); Nicholas Kent Bang, Omaha, NE (US); Nathan Daniel Poppe, Omaha, NE (US); Marco Anghileri, Milan (IT); Valeria Di Giacomo, Milan (IT)

(73) Assignee: Lindsay Transportation Solutions, LLC, Omaha, NE (US)

( * ) Notice: Subject to any disclaimer, the term of this patent is extended or adjusted under 35 U.S.C. 154(b) by 382 days.

(21) Appl. No.: 18/165,599

(22) Filed: Feb. 7, 2023

(65) Prior Publication Data

US 2024/0263409 A1 Aug. 8, 2024

(51) Int. Cl.
*E01F 15/14* (2006.01)

(52) U.S. Cl.
CPC ..... *E01F 15/146* (2013.01)

(58) Field of Classification Search
CPC ..... E01F 15/00; E01F 15/04; E01F 15/0461; E01F 15/146; E01F 15/0423; E01F 15/143
See application file for complete search history.

(56) References Cited

U.S. PATENT DOCUMENTS 1,677,796 A * 7/1928 Parks ..... E21D 15/22 248/548
4,330,106 A * 5/1982 Chisholm ..... E01F 15/0423 256/19
4,607,824 A * 8/1986 Krage ..... E01F 9/685 256/19

(Continued)

FOREIGN PATENT DOCUMENTS

CN 107338746 A 11/2017
EP 2383391 A2 11/2011

(Continued)

OTHER PUBLICATIONS

International Search Report and Written Opinion in related PCT Application PCT/US2024/013431 mailed Jun. 5, 2024, 11 pages.

(Continued)

*Primary Examiner* — Daniel J Wiley
(74) *Attorney, Agent, or Firm* — HOVEY WILLIAMS LLP

(57) ABSTRACT

A crash cushion apparatus broadly comprising a rail assembly, a number of dividers and a number of side panels forming a number of collapsible bays, and a number of crushable tubes. The rail assembly includes a number of anchor plates and a rail. The dividers are longitudinally spaced apart from each other and slidably entrained on the rail. The side panels link the dividers together. The crushable tubes are oriented longitudinally in spaces formed by the collapsible bays and extend between sequentially adjacent ones of the dividers. The dividers entrain the crushable tubes (Continued)

in the longitudinal orientation without the crushable tubes being fixed to the dividers. The dividers are configured to be driven rearward along the rail and crush the crushable tubes to sequentially collapse the collapsible bays.

20 Claims, 6 Drawing Sheets

(56) References Cited

U.S. PATENT DOCUMENTS 4,655,434 A * 4/1987 Bronstad ..... E01F 15/143 403/2
4,784,515 A * 11/1988 Krage ..... E01F 9/638 404/6
4,815,565 A * 3/1989 Sicking ..... E01F 15/146 404/6
5,022,782 A * 6/1991 Gertz ..... E01F 15/143 404/6
5,733,062 A * 3/1998 Oberth ..... E01F 15/146 404/6
5,868,521 A * 2/1999 Oberth ..... E01F 15/146 404/6
5,957,435 A * 9/1999 Bronstad ..... E01F 15/143 404/6
6,293,727 B1 * 9/2001 Albritton ..... E01F 15/146 404/6
6,536,986 B1 * 3/2003 Anghileri ..... E01F 15/146 404/6
7,059,590 B2 * 6/2006 Bronstad ..... E01F 15/083 256/13.1
7,101,111 B2 * 9/2006 Albritton ..... E01F 15/0423 404/6
7,210,874 B2 * 5/2007 Albritton ..... E01F 15/146 404/6
7,530,548 B2 * 5/2009 Ochoa ..... E01F 15/143 404/6
8,215,619 B2 * 7/2012 Leonhardt ..... E01F 15/025 256/13.1
8,596,903 B2 * 12/2013 Hur ..... E01F 15/146 404/6
9,051,698 B1 * 6/2015 Anghileri ..... E01F 15/146
9,200,417 B2 * 12/2015 Leonhardt ..... E01F 15/0423
9,725,857 B2 8/2017 Cho
9,790,653 B2 * 10/2017 Thompson ..... E01F 15/146
11,453,988 B2 * 9/2022 Lim ..... E01F 15/0438
2003/0057410 A1 * 3/2003 Denman ..... E01F 15/146 256/13.1
2003/0210954 A1 * 11/2003 Kang ..... E01F 15/146 404/6
2006/0011900 A1 * 1/2006 Ochoa ..... E01F 15/0438 256/13.1
2006/0054876 A1 * 3/2006 LaTurner ..... E01F 15/146 404/6
2006/0193688 A1 * 8/2006 Albritton ..... E01F 15/146 404/6
2008/0085153 A1 4/2008 LaTurner et al.
2011/0091273 A1 * 4/2011 Sayre ..... C08G 18/3215 404/6
2021/0108383 A1 * 4/2021 Maus ..... E01F 15/0423
2024/0263410 A1 8/2024 Nagy et al.

FOREIGN PATENT DOCUMENTS

KR 200355899 Y1 7/2004
KR 20090005914 A 1/2009
KR 101847463 B1 4/2018
KR 102082861 B1 3/2020
KR 10-2020-0088069 A 7/2020
RU 172528 U1 7/2017
RU 199464 U1 7/2017

OTHER PUBLICATIONS

QuadGuard Product Description Manual, Trinity Highway Products Energy Absorption Systems, May 2013, 64 Pages.
International Search Report and Written Opinion in related PCT Application PCT/US2024/049798 mailed Jan. 17, 2025, 13 pages.

* cited by examiner

RESTORABLE CRASH CUSHION APPARATUS

BACKGROUND

Crash cushion apparatuses are often placed in road medians and shoulders to safely redirect or arrest wayward vehicles. Some crash cushion apparatuses include crushable tubes affixed in collapsible bays for absorbing and dispersing impact forces. Unfortunately, the crushable tubes can be imperfectly affixed in the collapsible bays (e.g., via cracked welds or broken fasteners) in ways that are impossible or at least impractical to identify and address. The crushable tubes also often buckle and bend when crushed, which negates their effectiveness and introduces unpredictable behavior. Furthermore, slideable dividers forming the collapsible bays sometimes bind on their rails, thus preventing impact forces from reaching the crushable tubes and being dissipated from the vehicles. Crash cushion apparatuses are also difficult to inspect and restore after impact events, resulting in significant roadside hazardous exposure to workers.

SUMMARY

Embodiments of the invention solve the above-mentioned problems and other problems and provide a distinct advance in the art of crash cushion apparatuses. More particularly, the invention provides a restorable crash cushion apparatus including crushable tubes that are entrained but not affixed in collapsible bays and that have improved crushing characteristics. The crash cushion apparatus also includes slideable dividers with improved sliding characteristics. These and other features ensure more effective and predictable impact behavior.

An embodiment of the crash cushion apparatus is configured to be positioned in a road median or shoulder to mitigate head-on vehicle impacts and deflect side impacts and broadly comprises a rail assembly; a number of dividers and side panels that together form a number of collapsible bays entrained on the rail assembly; a nose component configured to be impacted by a vehicle during a head-on impact event and remain substantially intact as it is driven rearward toward the collapsible bays; and a number of crushable tubes entrained but not affixed in the collapsible bays. The crushable tubes crush longitudinally during a head-on impact event, thereby eliminating the need for tube crushing guidance structure.

The rail assembly supports the collapsible bays and the nose component and permits the nose component to be driven toward and initiate collapse of the collapsible bays. An embodiment of the rail assembly includes a number of anchor plates, opposing rails, and a number of crossmembers. The rail assembly is attached to a backstop.

The anchor plates are rigidly affixed to a substrate or ground surface via threaded bolts or other similar components so that the rail assembly does not move during an impact event. Each anchor plate is a flat plate spaced apart from sequentially adjacent anchor plates.

The backstop helps prevent an impacting vehicle from advancing further and is positioned near the rearward end of the crash cushion apparatus and includes an anchor plate affixed to the ground or road surface. To that end, the backstop is a fixed point at which tubes in the aft-most collapsible bay crush against in the longitudinal direction.

The opposing rails extend longitudinally from the forward end to the rearward end and are fixed in place via the anchor plates. Each of the opposing rails includes a riser and a ledge.

Each of the crossmembers extends laterally between the opposing rails on one of the anchor plates. This increases rigidity of the rail assembly.

The dividers are longitudinally spaced apart from each other and slidably entrained on the rails. Each of the dividers includes vertical members and horizontal members, opposing tabs, and one or more cradle members and entrainment members depending on the divider's position. Each of the dividers also includes beveled (filleted, chamfered, or tapered) surfaces.

The horizontal members extend between the vertical members and abut ends of the crushable tubes. This entrains the crushable tubes in the corresponding collapsible bays and allows impact forces to be transferred between the crushable tubes and the dividers. The horizontal members and crushable tubes are not fixed together.

The opposing tabs are spaced below the ledges of the rails by a gap and extend inwardly toward the risers of the rails to prevent the dividers from becoming derailed. The gap is a predetermined width that optimally facilitates movement between the dividers and the rails.

Each cradle member extends laterally and adjacent to one of the horizontal members of a corresponding divider and includes one or more recesses corresponding to a number of crushable tubes disposed in the corresponding collapsible bay. The cradle member supports an end of one or more of the crushable tubes and prevents lateral and vertical movement thereof.

Each entrainment member extends laterally and adjacent to one of the horizontal members of a corresponding divider and over ends of corresponding crushable tubes. The entrainment member, together with a corresponding cradle member entrains the crushable tube in a longitudinal orientation in the corresponding collapsible bay without the crushable tube being fixed to the corresponding divider.

The beveled surfaces are disposed near the rails and are configured to engage the rails during an impact event. The beveled surfaces improve movement of the dividers relative to the rails.

The side panels extend between and are attached to sides of sequential dividers and may include a number of holes and a number of horizontal slots and horizontal grooves for receiving biased fasteners. Each side panel is corrugated thereby increasing rigidity and impact reactivity for deflecting side impacts and redirecting side impact forces. The side panels overlap adjacent side panels so that the side panels slide next to (i.e., nest with) each other in an impact event.

The biased fasteners attach the side panels to the dividers via the slots and corresponding holes of adjacent panels. The biased fasteners include a bolt, a sliding guide, a nut, and a biasing element.

The bolt extends through the slot and through a fastener hole of a vertical member of one of the dividers. In some embodiments, the bolt also extends through the biasing element (particularly in the case of a helical spring). A head end of the bolt is attached to or in inter-engagement with the sliding guide.

The sliding guide is positioned on an outer side of the corresponding panel in the horizontal groove in inter-engagement with a head of the bolt. The sliding guide is elongated for guiding the corresponding panel via the horizontal groove as the panel slides relative to the biased fastener.

The nut retains the biasing element in engagement with the corresponding divider. In the case of a helical spring, the nut entrains the biasing element on the bolt.

The biasing element adds tension to the corresponding panel to keep the panel in place while allowing it to slide more freely during an impact event. The biasing element may be a coil spring, a Belleville washer, a urethane spring, a leaf spring, or the like. In another embodiment, no biasing element is used.

Some of the dividers and/or the nose component optionally include shock absorption elements for reducing spikes in energy transfer (e.g., minimize shock) between some of the dividers and other components. The shock absorption elements may be rubber or similar material. These can also be used to aid in alignment of the dividers.

The nose component includes a number of rigidly connected members, a delineation plate, a set of tabs, and a set of beveled surfaces similar to the beveled surfaces described above.

The rigidly connected members form a box frame near the forward end of the crash cushion apparatus. The rigidly connected members are sufficiently strong to transfer loads into the dividers and the crushable tubes without absorbing much energy themselves (except the energy that initiates movement of the nose component).

The delineation plate extends between some of the rigidly connected members and together with opposing side panels at least partially enclose the box frame. The delineation plate may include curved edges complementary to the corrugated shape of forwardmost side panels.

The tabs are spaced below the ledges of the rails by a gap and extend inwardly toward the risers of the rails to prevent the nose component from becoming derailed from the rails. As discussed above, the gap is a predetermined width that optimally facilitates movement between the nose component and the rails.

The beveled surfaces are disposed near the rails and are configured to engage the rails during an impact event. The beveled surfaces improve movement of the nose component relative to the rails. In other words, the beveled surfaces reduce binding between the nose component and the rails.

The crushable tubes are oriented longitudinally in the collapsible bays and extend between sequentially adjacent ones of the dividers such that the dividers (and more specifically, the cradle members and entrainment members) entrain the crushable tubes in the longitudinal orientation without the crushable tubes being fixed to the dividers.

Each crushable tube may include one or more holes near one of its ends (e.g., a forward end) for promoting longitudinal and progressive collapse of the crushable tube. Edges of the hole(s) may be between approximately 0.5 inches to approximately 3 inches from the end of the crushable tube. In one embodiment, each crushable tube includes four holes, one on each side.

The crushable tubes are distributed unevenly between the collapsible bays so that at least one of the collapsible bays has more crushable tubes than at least one other of the collapsible bays. In one embodiment, the crushable tubes increase in number per collapsible bay from the forward end to the rearward end of the crash cushion apparatus. In another embodiment, one of the forward-most collapsible bays of the collapsible bays has zero crushable tubes. In yet another embodiment, the foremost collapsible bay (nearest to the nose component includes zero crushable tubes, the next two collapsible bays include three crushable tubes each, the next collapsible bay includes four crushable tubes, the next collapsible bay includes six crushable tubes, and the aftmost collapsible bay includes eight crushable tubes. The crushable tubes may include upper crushable tubes positioned near tops of the dividers and lower crushable tubes positioned near bottoms of the dividers.

The crash cushion apparatus arrests a vehicle impacting the nose component. Specifically, the nose component is driven rearward on the rails toward the foremost divider, thus collapsing the first collapsible bay. Similarly, the side panels corresponding to the first collapsible bay are overlapped by side panels of the nose component and begin to slide rearward via the biased fasteners. The shock absorption elements reduce spikes in energy transfer (e.g., minimize shock) between some of the dividers (and particularly the foremost dividers) and other components.

The nose component continues to be driven rearward, thus sequentially collapsing corresponding collapsible bays until the vehicle is stopped. The dividers crush the crushable tubes in the collapsible bays as the dividers are driven rearward.

The above-described crash cushion apparatus provides several advantages. For example, the dividers entrain the crushable tubes in their longitudinal orientation in the collapsible bays without the crushable tubes being fixed to the dividers. This helps ensure that energy transfer between the dividers and the crushable tubes is primarily due to longitudinal rearward movement of the dividers and not from a wider array of forces transferable between fixed joints (e.g., lateral stress, bending, twisting, stretching, recoil, or the like). The crushable tubes being entrained only (and not fixed to the dividers) also ensures the crushable tubes are properly installed—it is not necessary to inspect welds or fasteners between the dividers and the crushable tubes. The entrainment members also prevent theft of the crushable tubes. Furthermore, this also facilitates safely inspecting, restoring, re-building and/or re-using elements of the crash cushion apparatus after an impact event.

The holes of the crushable tubes promote longitudinal and progressive collapse of the crushable tubes, thus mitigating buckling and bending of the crushable tubes during an impact event. The holes of the crushable tubes also reduce the energy spike associated with the forces required to initiate crushing of the crushable tubes. The increasing number of crushable tubes per collapsible bay in some embodiments allows the crash cushion apparatus to safely arrest vehicles of different sizes.

The dividers have improved moveability relative to the rails during an impact event due to the gaps between the tabs of the dividers and the ledge of the rails. The beveled surfaces of the dividers also improve moveability of the dividers during an impact event. Specifically, the gaps and the beveled surfaces prevent binding between the dividers and the rails as the dividers are driven rearward. These features also facilitate restoration of the crash cushion apparatus.

The side panels redirect side impacts while not inhibiting the collapsing of the collapsible bays during head-on impact events. To that end, the side panels overlap each other while being slideably linked to the dividers via the biased fasteners and the slots and grooves of the side panels. This also reduces the amount of damage to various components of the crash cushion apparatus during an impact event, which allows the crash cushion apparatus to be refurbished more easily and placed back in service more quickly.

This summary is provided to introduce a selection of concepts in a simplified form that are further described below in the detailed description. This summary is not intended to identify key features or essential features of the claimed subject matter, nor is it intended to be used to limit the scope of the claimed subject matter. Other aspects and advantages of the current invention will be apparent from the following detailed description of the embodiments and the accompanying drawing figures.

BRIEF DESCRIPTION OF THE DRAWING FIGURES

Embodiments of the current invention are described in detail below with reference to the attached drawing figures, wherein.

Figure 1:
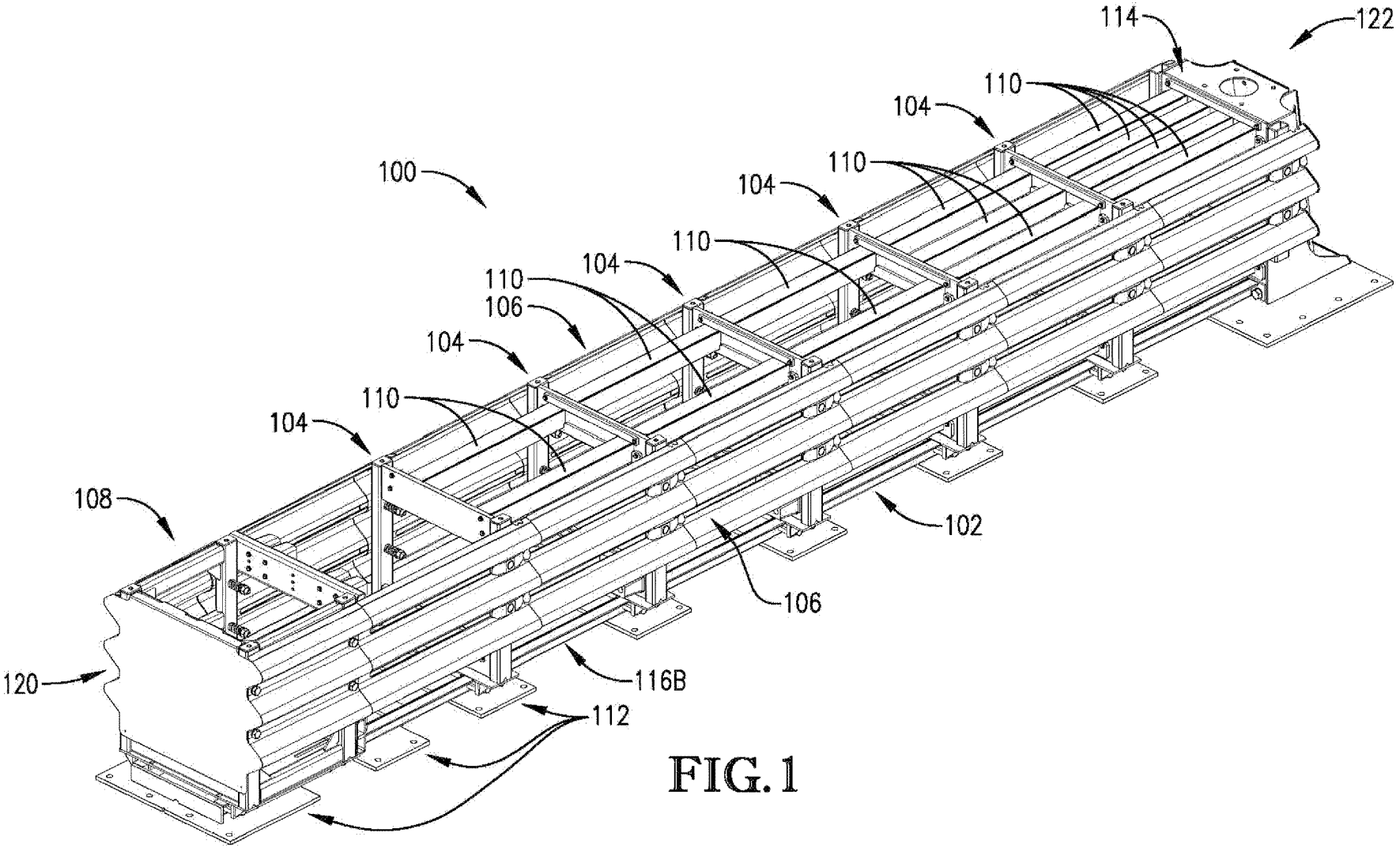
FIG. 1 is a perspective view of a crash cushion apparatus constructed in accordance with an embodiment of the invention.

The drawing figures do not limit the current invention to the specific embodiments disclosed and described herein. The drawings are not necessarily to scale, emphasis instead being placed upon clearly illustrating the principles of the invention.

DETAILED DESCRIPTION OF THE EMBODIMENTS

The following detailed description of the invention references the accompanying drawings that illustrate specific embodiments in which the invention can be practiced. The embodiments are intended to describe aspects of the invention in sufficient detail to enable those skilled in the art to practice the invention. Other embodiments can be utilized and changes can be made without departing from the scope of the present invention. The following detailed description is, therefore, not to be taken in a limiting sense. The scope of the present invention is defined only by the appended claims, along with the full scope of equivalents to which such claims are entitled.

In this description, references to "one embodiment", "an embodiment", or "embodiments" mean that the feature or features being referred to are included in at least one embodiment of the technology. Separate references to "one embodiment", "an embodiment", or "embodiments" in this description do not necessarily refer to the same embodiment and are also not mutually exclusive unless so stated and/or except as will be readily apparent to those skilled in the art from the description. For example, a feature, structure, act, etc. described in one embodiment may also be included in other embodiments, but is not necessarily included. As used in the specification and in the claims, ordering words such as "first" and "second" are used to distinguish between similar components and do not imply specific components. Thus, the current technology can include a variety of combinations and/or integrations of the embodiments described herein.

Turning to the drawing figures, a crash cushion apparatus 100 constructed in accordance with an embodiment of the invention is illustrated. The crash cushion apparatus 100 is configured to be positioned in a road median or shoulder to mitigate head-on vehicle impacts and deflect side impacts. The crash cushion apparatus 100 broadly comprises a rail assembly 102; a plurality of dividers 104 and a plurality of side panels 106 that together form a plurality of collapsible bays 142 entrained on the rail assembly 102; a nose component 108 configured to be impacted by a vehicle during a head-on impact event and remain substantially intact as it is driven rearward toward the collapsible bays 142; and a plurality of crushable tubes 110 that are entrained but not affixed in the collapsible bays 142 and that have improved crushing characteristics. To that end, the crushable tubes 110 crush longitudinally during a head-on impact event, thereby eliminating the need for tube crushing guidance structure.

The rail assembly 102 supports the plurality of dividers 104 and the nose component 108 and acts as a fixed base for the crash cushion apparatus 100 during an impact event. The rail assembly 102 may include a plurality of anchor plates 112, opposing rails 116A,B, and a plurality of crossmembers 118. The rail assembly 102 may be attached to a backstop 114.

The plurality of anchor plates 112 may be rigidly affixed to a substrate or ground surface so that the rail assembly 102 does not move during an impact event. Each anchor plate 112 may be a flat plate spaced apart from sequentially adjacent anchor plates. The anchor plates 112 may be affixed to the road or a ground surface via threaded anchor bolts or other similar components.

The backstop 114 is positioned near the rearward end 122 of the crash cushion apparatus 100 and includes an anchor plate 128 affixed to the ground or a road surface via threaded anchor bolts or other similar components. The backstop 114 helps prevent an impacting vehicle from advancing further. To that end, the backstop is a fixed point at which tubes in the aft-most collapsible bay crush against in the longitudinal direction.

The opposing rails 116A,B extend longitudinally from the forward end 120 to the rearward end 122 (and more specifically, to the backstop 114) and are fixed in place via the plurality of anchor plates 112. Each of the opposing rails 116A,B includes a riser 124 and a ledge 126, with the ledge 126 extending horizontally from an upper end of the riser 124.

Each of the plurality of crossmembers 118 extends laterally between the opposing rails 116A,B on one of the plurality of anchor plates 112. This increases rigidity of the rail assembly 102.

The plurality of dividers 104 are longitudinally spaced apart from each other and slidably entrained on the rails 116A,B. Each of the plurality of dividers 104 includes vertical members 130 and horizontal members 132 thereby forming a rectangular structure. Each of the plurality of dividers 104 further includes opposing tabs 134A,B, one or more cradle members 136, and one or more entrainment members 138. Each of the plurality of dividers 104 may also include beveled (filleted, chamfered, or tapered) surfaces 140A,B.

The plurality of dividers 104 together with the plurality of side panels 106 form a plurality of collapsible bays 142. The collapsible bays 142 entrain the crushable tubes 110 in spaces formed by the plurality of dividers 104 and plurality of side panels 106 as described below. The dividers 104 have improved sliding characteristics, which ensure more effective and predictable impact behavior.

The horizontal members 132 extend between the vertical members 130 and abut ends of the crushable tubes 110. This entrains the crushable tubes 110 in the corresponding collapsible bays 142 and allows impact forces to be transferred between the crushable tubes 110 and the dividers 104. The horizontal members 132 and crushable tubes 110 are not fixed together.

The opposing tabs 134A,B are spaced below the ledges 126 of the rails 116A,B by a gap 144 and extend inwardly toward the risers 124 of the rails 116A,B to prevent the plurality of dividers 104 from becoming derailed from the rails 116A,B. The gap 144 may be a predetermined amount that optimally facilitates movement between the plurality of dividers 104 and the rails 116A,B. A gap size too small, a non-existent gap, or a gap size too large results in binding between the plurality of dividers 104 and the rails 116A,B, derailment, or poor energy transfer during an impact event. The gap 144 also facilitates restoration of the crash cushion apparatus 100. In one embodiment, the gap is between approximately $3/8^{th}$ inch and approximately $1/8^{th}$ inch.

Figure 5:
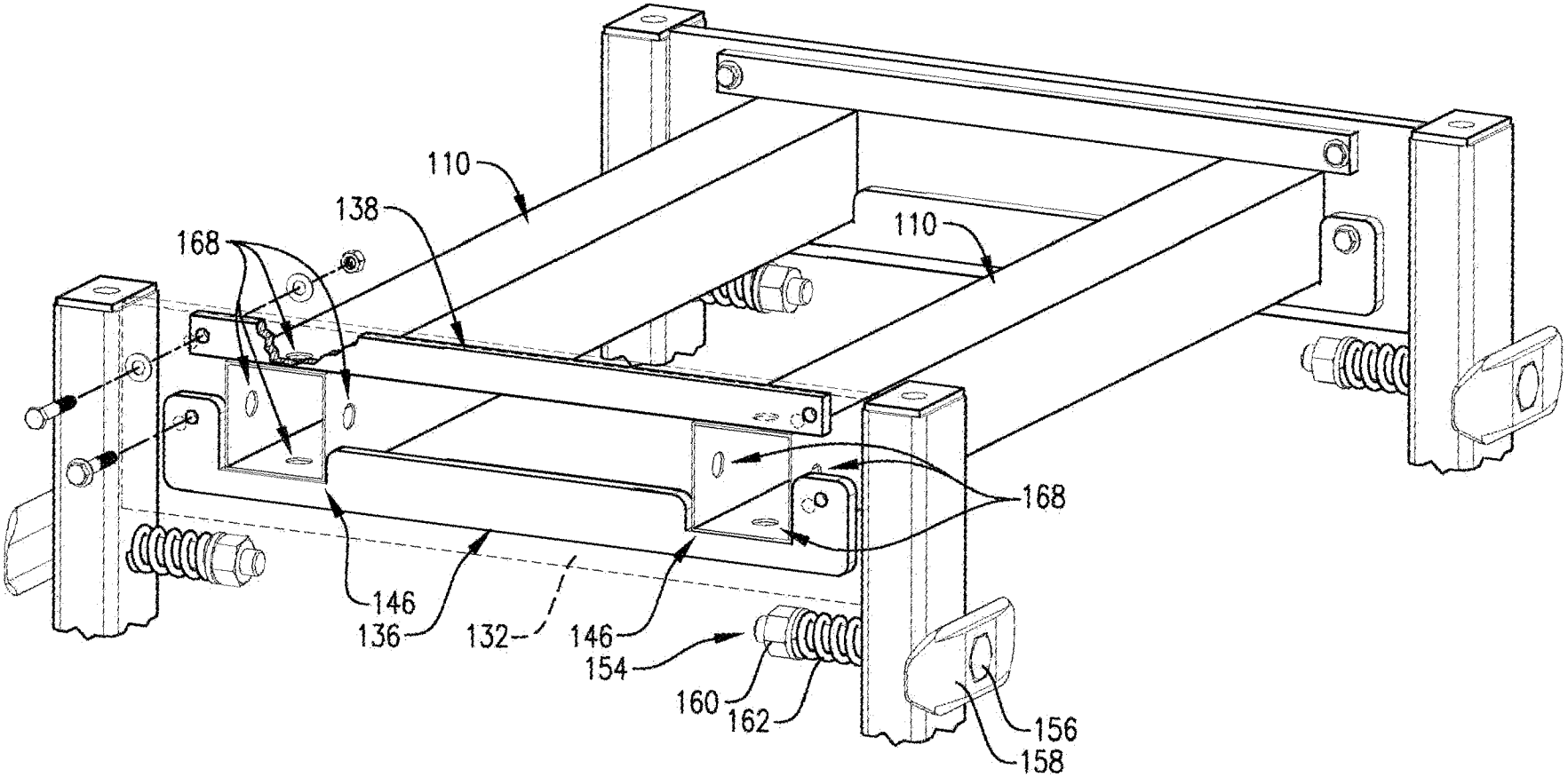
FIG. 5 is an enlarged perspective view of certain components of the crash cushion apparatus of FIG. 1.

As best seen in FIG. 5, each cradle member 136 extends laterally and adjacent to one of the horizontal members 132 of a corresponding divider 104 and includes one or more recesses 146 corresponding to a number of crushable tubes 110 disposed in the corresponding collapsible bay 142. The cradle member 136 supports an end of one or more of the crushable tubes 110 and prevents lateral movement thereof.

Each entrainment member 138 extends laterally and adjacent to one of the horizontal members 132 of a corresponding divider 104 and over ends of corresponding crushable tubes 110. The entrainment member 138, together with a corresponding cradle member 136 entrain the crushable tube 110 in a longitudinal orientation in the corresponding collapsible bay 142 without the crushable tube 110 being fixed to the corresponding divider 104. The entrainment members 138 also prevent theft of the crushable tubes 110.

Figure 4:
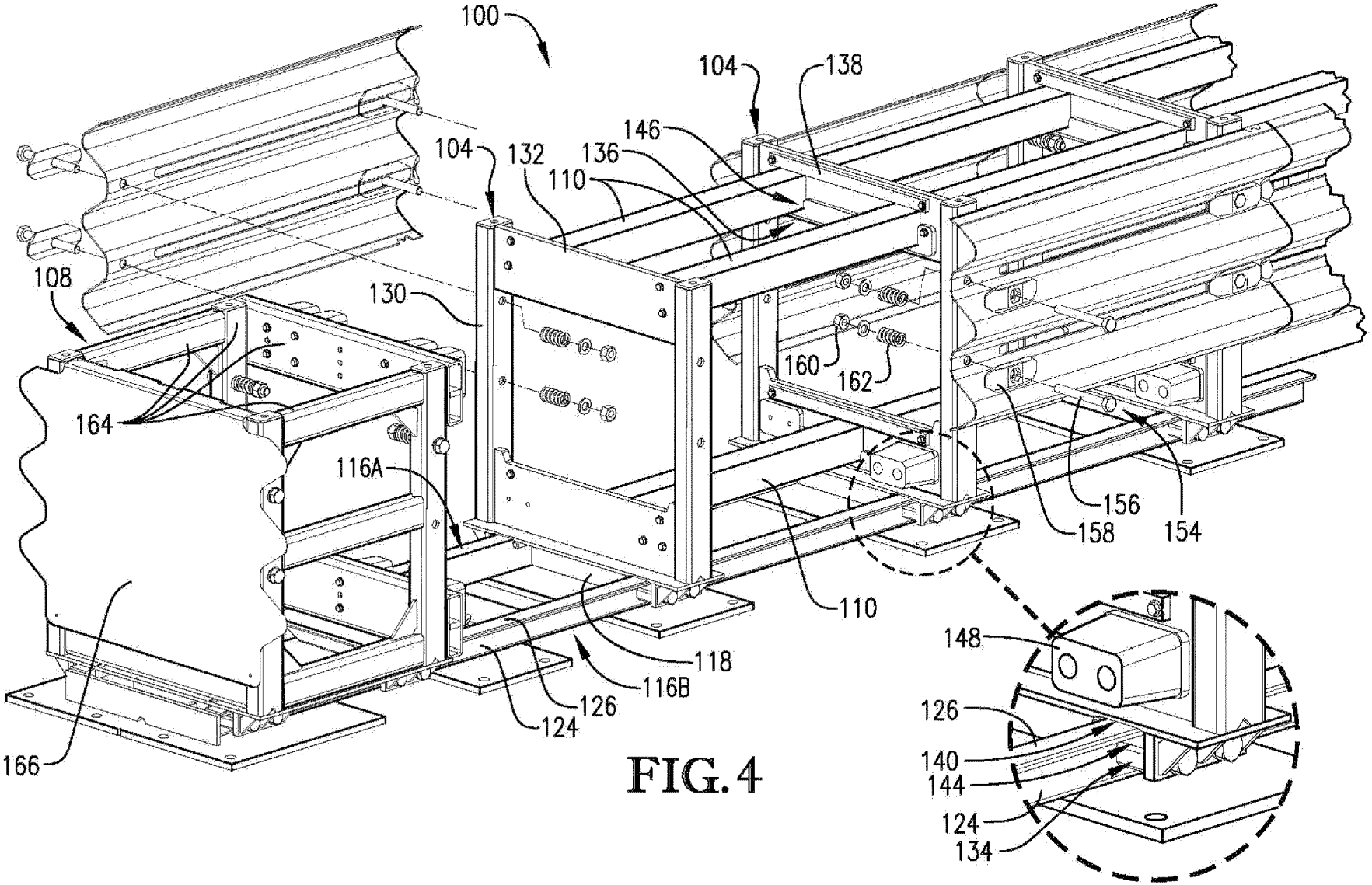
FIG. 4 is an enlarged perspective view of the crash cushion apparatus of FIG. 1.
Figure 6:
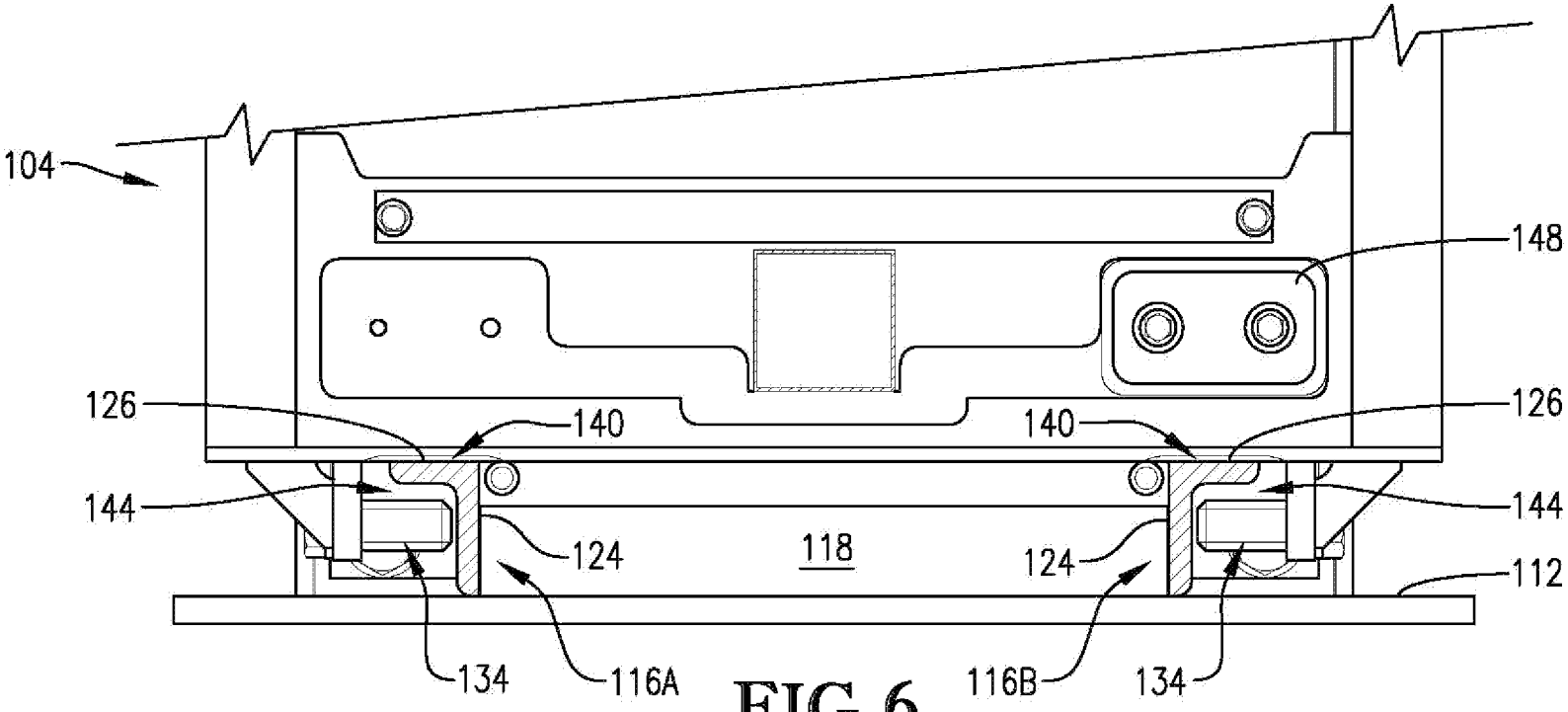
FIG. 6 is an enlarged front elevation view of certain components of the crash cushion apparatus of FIG. 1.

As best seen in FIGS. 4 and 6, the beveled surfaces 140A,B are disposed near the rails 116A,B and are configured to engage the rails 116A,B during an impact event. The beveled surfaces 140A,B improve movement of the plurality of dividers 104 relative to the rails 116A,B. In other words, the beveled surfaces 140A,B reduce binding between the plurality of dividers 104 and the rails 116A,B.

Figure 2:
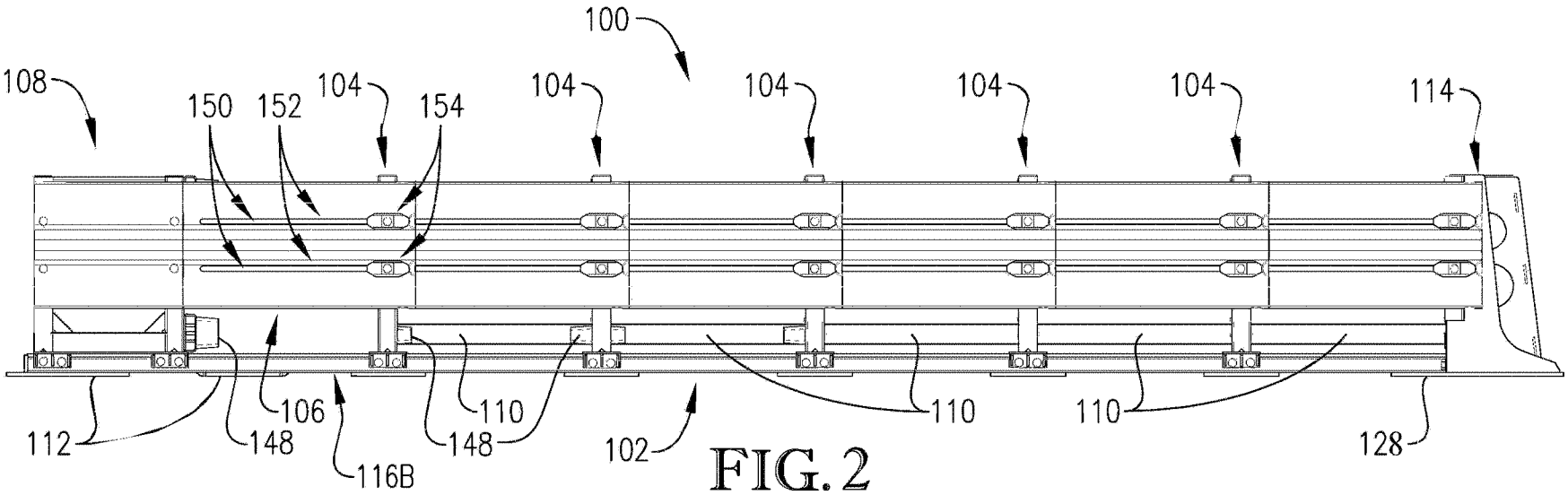
FIG. 2 is a side elevation view of the crash cushion apparatus of FIG. 1.

As best seen in FIGS. 2 and 4, the plurality of side panels 106 extend between and are attached to sides of sequential dividers 104 and may include horizontal slots 150 and horizontal grooves 152 for receiving biased fasteners 154. Each side panel 106 may be corrugated or have similar geometries thereby increasing rigidity and impact reactivity for deflecting side impacts and redirecting side impact forces. The side panels 106 may overlap adjacent side panels 106 so that the side panels 106 slide next to (i.e., nest with) each other in an impact event. Additional side panels may extend aft of the backstop 114.

As best seen in FIGS. 4 and 5, the biased fasteners 154 attach the side panels 106 to the dividers 104 via the slots 150 and corresponding holes of adjacent panels 106. The biased fasteners 154 include a bolt 156, a sliding guide 158, a nut 160, and a biasing element 162. The biased fasteners 154 facilitate the aforementioned sliding action and minimize damage that must be fixed before the crash cushion apparatus 100 can be reused after an impact event.

The bolt 156 extends through the slot 150, through a hole of an adjacent panel 106, and through a fastener hole of a vertical member 130 of one of the dividers 104. In this way, adjacent panels 106 are connected to one of the dividers 104 with one of the adjacent panels 106 being slideable relative to the divider 104 and the other one of the adjacent panels 106 being fixed relative to the divider 104. In some embodiments, the bolt 156 also extends through the biasing element 162 (particularly in the case of a helical spring). A head end of the bolt 156 is attached to or in inter-engagement with the sliding guide 158.

The sliding guide 158 is positioned on an outer side of the corresponding panel 106 in the horizontal groove 152 in inter-engagement with a head of the bolt 156. The sliding guide 158 may be elongated for guiding the corresponding panel 106 via the horizontal groove 152 as the panel 106 slides relative to the biased fastener 154.

The nut 160 retains the biasing element in engagement with the corresponding divider 104. In the case of a helical spring, the nut 160 entrains the biasing element on the bolt 156. To that end, the nut 160 may be welded to the bolt 156 or may be an integral part of the bolt 156. Alternatively, a bolt head, a flange, or the like may be used.

The biasing element 162 adds tension to the corresponding panel 106 to keep the panel 106 in place while allowing it to slide more freely during an impact event. The biasing element 162 may be a coil spring, a Belleville washer, a urethane spring, a leaf spring, or the like. In another embodiment, no biasing element is used.

Figure 3:
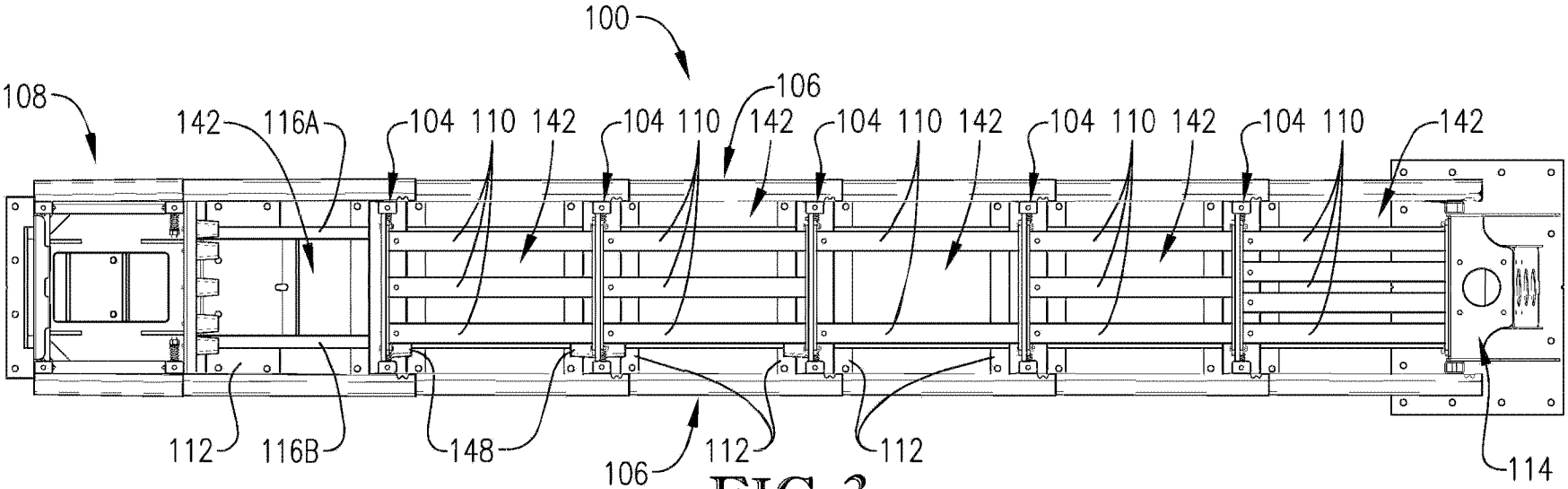
FIG. 3 is a top plan view of the crash cushion apparatus of FIG. 1.

As best seen in FIGS. 2-4, some of the dividers 104 and/or the nose component 108 include shock absorption elements 148 for reducing spikes in energy transfer (e.g., minimize shock) between some of the dividers 104 and other components. The shock absorption elements 148 may be rubber or similar material.

As best seen in FIG. 4, the nose component 108 includes a plurality of rigidly connected members 164, a delineation plate 166, side panels, a set of tabs similar to tabs 134, and a set of beveled surfaces similar to beveled surfaces 140. The nose component 108 is configured to be impacted by a vehicle during a head-on impact event and remain substantially intact as it is driven rearward toward the dividers 104.

The plurality of rigidly connected members 164 form a box frame near the forward end 120 of the crash cushion apparatus 100. The plurality of rigidly connected members 164 are sufficiently strong to transfer loads into the dividers 104 and the crushable tubes 110 without absorbing much energy themselves (except the energy that initiates movement of the nose component 108).

The delineation plate 166 extends between some of the plurality of rigidly connected members 164 thereby at least partially enclosing the box frame. The delineation plate 166 may include curved edges complementary to the corrugated shape of forwardmost side panels 106.

The tabs are spaced below the ledges 126 of the rails 116A,B by a gap and extend inwardly toward the risers 124 of the rails 116A,B to prevent the nose component 108 from becoming derailed from the rails 116A,B. As discussed above, the gap may be a predetermined amount that optimally facilitates movement between the nose component 108 and the rails 116A,B. A gap size too small, a non-existent gap, or a gap size too large results in binding between the nose component 108 and the rails 116A,B, derailment, or poor energy transfer during an impact event. The gap also facilitates restoration of the crash cushion apparatus 100 after an impact event. In one embodiment, the gap is between approximately $3/8^{th}$ inch and approximately $1/8^{th}$ inch.

The beveled surfaces are disposed near the rails 116A,B and are configured to engage the rails 116A,B during an impact event. The beveled surfaces improve movement of the nose component 108 relative to the rails 116A,B. In other words, the beveled surfaces reduce binding between the nose component 108 and the rails 116A,B.

As best seen in FIGS. 3 and 5, the plurality of crushable tubes 110 are oriented longitudinally in spaces formed by the plurality of collapsible bays 142 and extend between sequentially adjacent ones of the plurality of dividers 104 such that the plurality of dividers 104 (and more specifically, the cradle members and entrainment members 138) entrain the plurality of crushable tubes 110 in the longitudinal orientation without the plurality of crushable tubes 110 being fixed to the plurality of dividers 104.

Each crushable tube 110 may include one or more holes 168 near one of its ends (e.g., a forward end) for promoting longitudinal and progressive collapse of the crushable tube 110. Edges of the hole(s) 168 may be between approximately 0.5 inches to approximately 3 inches from the end of the crushable tube 110. In one embodiment, each crushable tube 110 includes four holes 168, one on each side.

The plurality of crushable tubes 110 may be distributed unevenly between the plurality of collapsible bays 142 so that at least one of the plurality of collapsible bays 142 has more crushable tubes than at least one other of the plurality of collapsible bays 142. In one embodiment, the plurality of crushable tubes 110 increase in number per collapsible bay from the forward end 120 to the rearward end 122 of the crash cushion apparatus 100. In another embodiment, one of the forward-most collapsible bays 142 of the plurality of collapsible bays 142 has zero crushable tubes. In another embodiment, the foremost collapsible bay (nearest to the nose component 108 includes zero crushable tubes, the next two collapsible bays include three crushable tubes each, the next collapsible bay includes four crushable tubes, the next collapsible bay includes six crushable tubes, and the aftmost collapsible bay includes eight crushable tubes. The crushable tubes 110 may include upper crushable tubes positioned near tops of the dividers 104 and lower crushable tubes positioned near bottoms of the dividers 104.

Figure 7:
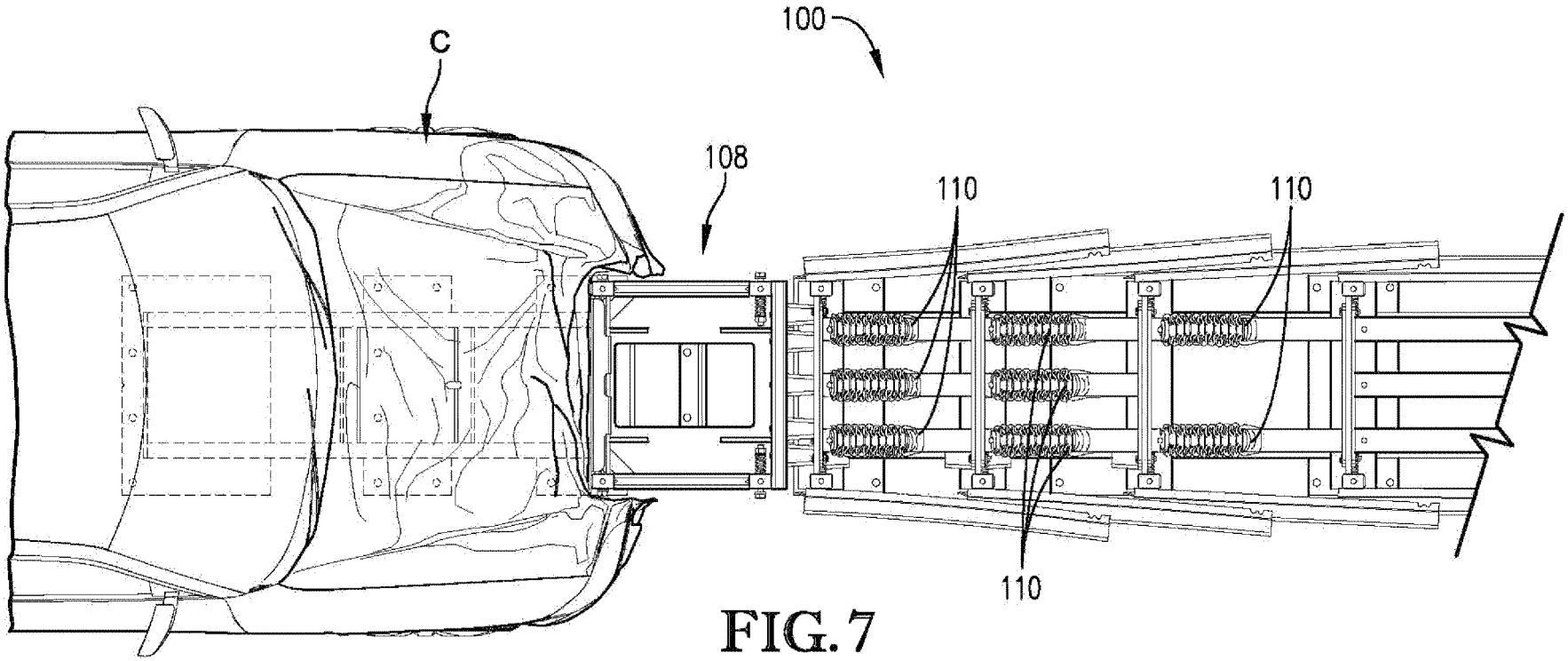
FIG. 7 is a top plan view of the crash cushion apparatus of FIG. 1 during an impact event.

Turning to FIG. 7, the crash cushion apparatus 100 arrests a vehicle impacting the nose component 108. Specifically, the nose component 108 is driven rearward on the rails 116A,B toward the foremost divider 104, thus collapsing the first collapsible bay 142. Similarly, the side panels 106 corresponding to the first collapsible bay 142 are overlapped by side panels of the nose component 108 and begin to slide rearward via the biased fasteners 154. The shock absorption elements 148 reduce spikes in energy transfer (e.g., minimize shock) between some of the dividers 104 (and particularly the foremost dividers 104) and other components.

The nose component 108 continues to be driven rearward, thus sequentially collapsing corresponding collapsible bays 142 until the vehicle is stopped. The dividers 104 crush the crushable tubes 110 in the collapsible bays 142 as the dividers 104 are driven rearward.

The above-described crash cushion apparatus 100 provides several advantages. For example, the dividers 104 entrain the crushable tubes 110 in their longitudinal orientation in spaces formed by the collapsible bays 142 without the crushable tubes 110 being fixed to the dividers 104. This helps ensure that energy transfer between the dividers 104 and the crushable tubes 110 is primarily due to longitudinal rearward movement of the dividers 104 and not from a wider array of forces transferable between fixed joints (e.g., lateral stress, bending, twisting, stretching, recoil, or the like). The crushable tubes 110 being entrained only (and not fixed to the dividers 104) also ensures the crushable tubes 110 are properly installed—it is not necessary to inspect welds or fasteners between the dividers 104 and the crushable tubes 110. The entrainment members 138 also prevent theft of the crushable tubes 110. Furthermore, this also facilitates safely inspecting, restoring, re-building and/or re-using elements of the crash cushion apparatus 100 after an impact event.

The holes 168 of the crushable tubes 110 promote longitudinal and progressive collapse of the crushable tube 110, thus mitigating buckling and bending of the crushable tubes 110 during an impact event. This also eliminates the need for tube crushing guidance structure. The holes 168 of the crushable tubes 110 also reduce the energy spike associated with the forces required to initiate crushing of the crushable tubes 110. The increasing number of crushable tubes per collapsible bay in some embodiments facilitates a gradual arrest of the vehicle and maximum safety for its occupants.

The dividers 104 have improved moveability relative to the rails 116A,B during an impact event due to the gaps 144 between the tabs 134 of the dividers 104 and the ledge 126 of the rails 116A,B. The beveled surfaces 140 of the dividers 104 also improve moveability of the dividers 104 during an impact event. Specifically, the gaps 144 and the beveled surfaces 140 prevent binding between the dividers 104 and the rails 116A,B as the dividers 104 are driven rearward and during system restoration.

The side panels 106 redirect side impacts while not inhibiting the collapsing of the collapsible bays 142 during head-on impact events. These side panels 106 may be doubled up to increase side impact resistance. To that end, the side panels 106 overlap each other while being slideably linked to the dividers 104 via the biased fasteners 154 and the slots 150 and grooves 152 of the side panels 106. This also reduces the amount of damage to various components of the crash cushion apparatus 100 during an impact event, which allows the crash cushion apparatus 100 to be refurbished more easily and placed back in service more quickly.

Although the invention has been described with reference to the embodiments illustrated in the attached drawing figures, it is noted that equivalents may be employed and substitutions made herein without departing from the scope of the invention as recited in the claims.

Having thus described various embodiments of the invention, what is claimed as new and desired to be protected by Letters Patent includes the following:

1. A crash cushion apparatus comprising:

a rail assembly including:

a plurality of anchor plates longitudinally spaced apart from each other; and a rail extending longitudinally between the plurality of anchor plates;

a plurality of collapsible bays supported on the rail, each of the plurality of collapsible bays including:

a divider slidably entrained on the rail and longitudinally spaced from a divider of an adjacent one of the plurality of collapsible bays; and a plurality of side panels linking the dividers of the plurality of collapsible bays together, each of the plurality of collapsible bays forming a space; and a plurality of crushable tubes oriented longitudinally in the spaces formed by the plurality of collapsible bays and extending between sequentially adjacent ones of the plurality of dividers, the plurality of dividers entraining the plurality of crushable tubes in the longitudinal orientation without the plurality of crushable tubes being fixed to the plurality of dividers, the plurality of dividers being configured to be driven rearward along the rail and crush the plurality of crushable tubes to sequentially collapse the collapsible bays;

each divider comprising one or more cradle members configured to receive a longitudinal end of a respective one of the plurality of crushable tubes so as to prevent displacement of the crushable tubes relative to the dividers without affixing the crushable tubes to the divider.

2. The crash cushion apparatus of claim 1, the plurality of crushable tubes being distributed unevenly between the plurality of collapsible bays so that at least one of the plurality of collapsible bays has more of the plurality of crushable tubes than at least one other of the plurality of collapsible bays.

3. The crash cushion apparatus of claim 2, the crash cushion apparatus having opposing forward and rearward ends, the plurality of crushable tubes increasing in number per collapsible bay from the forward end to the rearward end.

4. The crash cushion apparatus of claim 3, one of the forward-most collapsible bays of the plurality of collapsible bays having zero crushable tubes.

5. The crash cushion apparatus of claim 2, some of the plurality of collapsible bays having one more crushable tube than the sequentially adjacent collapsible bay forward therefrom.

6. The crash cushion apparatus of claim 1, each of the plurality of dividers including an entrainment member extending over the ends of the crushable tubes disposed in the corresponding collapsible bay.

7. The crash cushion apparatus of claim 1, each of the plurality of crushable tubes including opposing ends and a plurality of holes near one of the opposing ends for promoting consistent longitudinal and progressive collapse of the plurality of crushable tubes.

8. The crash cushion apparatus of claim 1, the rail assembly including an additional rail laterally spaced from the rail, the rail assembly further including crossmembers extending laterally between the rail and the additional rail.

9. The crash cushion apparatus of claim 1, each of the plurality of dividers including a tab slidably entraining the divider on the rail and spaced from the rail via a gap to prevent binding between the divider and the rail when the divider moves relative to the rail.

10. The crash cushion apparatus of claim 9, each of the plurality of dividers including a beveled or tapered surface configured to engage the rail.

11. The crash cushion apparatus of claim 1, some of the plurality of dividers including a rubber shock absorption element to minimize shock between the plurality of dividers.

12. The crash cushion apparatus of claim 1, the plurality of side panels overlapping each other and being connected the plurality of dividers via biased fasteners.

13. A crash cushion apparatus including opposing forward and rearward ends, the crash cushion apparatus comprising:

a rail assembly including:

a plurality of anchor plates longitudinally spaced apart from each other; and a rail extending longitudinally between the plurality of anchor plates;

a backstop positioned near an aft end of the rail:

a plurality of collapsible bays supported on the rail, each of the plurality of collapsible bays including:

a divider slidably entrained on the rail and longitudinally spaced from a divider of an adjacent one of the plurality of collapsible bays; and a plurality of side panels linking the dividers of the plurality of collapsible bays together, each of the plurality of collapsible bays forming a space;

a nose component near the forward end and slidably entrained on the rail in longitudinal alignment with the plurality of collapsible bays, the nose component including:

a plurality of rigidly-connected members forming a box frame; and a delineation plate extending between some of the plurality of rigidly-connected members thereby at least partially enclosing the box frame; and a plurality of crushable tubes oriented longitudinally in the spaces formed by the plurality of collapsible bays and extending between sequentially adjacent ones of the plurality of dividers, the plurality of dividers entraining the plurality of crushable tubes in the longitudinal orientation without the plurality of crushable tubes being fixed to the plurality of dividers, the plurality of dividers being configured to be driven rearward along the rail via the nose component and crush the plurality of crushable tubes to sequentially collapse the collapsible bays;

each divider comprising one or more cradle members configured to receive a longitudinal end of a respective one of the plurality of crushable tubes so as to prevent displacement of the crushable tubes relative to the dividers without affixing the crushable tubes to the divider.

14. The crash cushion apparatus of claim 13, the plurality of crushable tubes being distributed unevenly between the plurality of collapsible bays so that at least one of the plurality of collapsible bays has more of the plurality of crushable tubes than at least one other of the plurality of collapsible bays.

15. The crash cushion apparatus of claim 14, the plurality of crushable tubes increasing in number per collapsible bay from the forward end to the rearward end.

16. The crash cushion apparatus of claim 15, one of the forward-most collapsible bays of the plurality of collapsible bays has zero crushable tubes.

17. The crash cushion apparatus of claim 14, some of the plurality of collapsible bays having one more crushable tube than the sequentially adjacent collapsible bay forward therefrom.

18. The crash cushion apparatus of claim 13, each of the plurality of dividers including an entrainment member extending over the ends of the crushable tubes disposed in the corresponding collapsible bay.

19. The crash cushion apparatus of claim 13, each of the plurality of crushable tubes including opposing ends and a plurality of holes near one of the opposing ends for promoting consistent longitudinal and progressive collapse of the plurality of crushable tubes.

20. A crash cushion apparatus including opposing forward and rearward ends, the crash cushion apparatus comprising:

a rail assembly including:

a plurality of anchor plates longitudinally spaced apart from each other;

a backstop fixed to one of the plurality of anchor plates;

opposing rails extending longitudinally between the plurality of anchor plates and including aft ends; and a plurality of crossmembers extending laterally between the opposing rails;

a backstop positioned near the aft ends of the opposing rails;

a plurality of collapsible bays supported on the opposing rails, each of the plurality of collapsible bays including:

a divider slideably entrained on the opposing rails and longitudinally spaced apart from a divider of an adjacent one of the plurality of collapsible bays; and a plurality of corrugated side panels linking the dividers of the plurality of collapsible bays together, the plurality of side panels and dividers of the plurality of collapsible bays being connected via biased fasteners, each of the plurality of collapsible bays forming a space;

a nose component near the forward end and slidably entrained on the opposing rails in longitudinal alignment with the plurality of dividers, the nose component including:

a plurality of rigidly-connected members forming a box frame; and a delineation plate extending between some of the plurality of rigidly-connected members thereby at least partially enclosing the box frame; and a plurality of crushable tubes oriented longitudinally in the spaces formed by the plurality of collapsible bays and extending between sequentially adjacent ones of the plurality of dividers, the plurality of crushable tubes including opposing ends and a plurality of holes near some of the opposing ends for promoting longitudinal and progressive collapse of the plurality of crushable tubes, the plurality of dividers entraining the plurality of crushable tubes in the longitudinal orientation without the plurality of crushable tubes being fixed to the plurality of dividers, the plurality of dividers being configured to be driven rearward along the rail via the nose component and crush the plurality of crushable tubes to sequentially collapse the collapsible bays;

each divider comprising one or more cradle members configured to receive a longitudinal end of a respective one of the plurality of crushable tubes so as to prevent displacement of the crushable tubes relative to the dividers without affixing the crushable tubes to the divider.

* * * * *